US009719640B2

(12) United States Patent
Jacobson et al.

(10) Patent No.: US 9,719,640 B2
(45) Date of Patent: Aug. 1, 2017

(54) MANHOLE LIGHTING SYSTEM

(71) Applicants: Shane Jacobson, McCallsburg, IA (US); Gavin Randall Gross, Nevada, IA (US); Paul Kenneth Lewis, Nevada, IA (US)

(72) Inventors: Shane Jacobson, McCallsburg, IA (US); Gavin Randall Gross, Nevada, IA (US); Paul Kenneth Lewis, Nevada, IA (US)

(73) Assignee: Light Ring, Inc., McCallsburg, IA (US)

( * ) Notice: Subject to any disclaimer, the term of this patent is extended or adjusted under 35 U.S.C. 154(b) by 0 days.

(21) Appl. No.: 14/717,537

(22) Filed: May 20, 2015

(65) Prior Publication Data

US 2015/0338035 A1 Nov. 26, 2015

Related U.S. Application Data

(60) Provisional application No. 62/000,789, filed on May 20, 2014, provisional application No. 62/034,542, filed on Aug. 7, 2014.

(51) Int. Cl.

| | |
|---|---|
| ***F21V 33/00*** | (2006.01) |
| ***F21L 4/02*** | (2006.01) |
| ***F21V 31/00*** | (2006.01) |
| ***E02D 29/14*** | (2006.01) |
| *F21S 8/02* | (2006.01) |

(Continued)

(52) U.S. Cl.

CPC ..... *F21L 4/02* (2013.01); *E02D 29/14* (2013.01); *F21V 31/00* (2013.01); *F21L 4/025* (2013.01); *F21L 4/027* (2013.01); *F21S 8/02* (2013.01); *F21V 31/005* (2013.01); *F21V 33/006* (2013.01); *F21W 2131/401* (2013.01); *F21Y 2103/33* (2016.08)

(58) Field of Classification Search

CPC ... F21L 4/02; F21L 4/025; F21L 4/027; F21L 4/00; F21V 31/00; F21V 31/005; F21V 33/00; F21V 33/006; F21Y 2103/02; F21Y 2103/022; E02D 29/14; F21S 8/022; F21S 8/02; F21W 2131/401

See application file for complete search history.

(56) References Cited

U.S. PATENT DOCUMENTS 4,862,335 A * 8/1989 Vadseth ..... B29C 61/0658 362/267
4,903,176 A * 2/1990 Chen ..... A44C 15/0015 362/103

(Continued)

*Primary Examiner* — Y M. Lee
(74) *Attorney, Agent, or Firm* — McKee, Voorhees & Sease, PLC

(57) ABSTRACT

A portable lighting system including a ring shaped body having a top surface, a bottom surface, an outside wall and an inside wall, the ring shaped body defining a body perimeter, a rim secured to the body and extending away from the outside wall, a plurality of lights secured about the body perimeter, and a power source operatively connected to the plurality of lights. The power source may be a battery or other power source and can power the lights in addition to a controller, camera, transceiver, or sensor. One or more of the lights may be flexibly secured to the body and the body may be secured in place through a variety of ways. A safety ring and/or accessory bracket may be secured atop the portable lighting system.

20 Claims, 8 Drawing Sheets

(51) Int. Cl.
*F21W 131/401* (2006.01)
*F21Y 103/33* (2016.01)

(56) References Cited

U.S. PATENT DOCUMENTS

2005/0002190 A1* 1/2005 Kramer ..... F21S 10/02
362/236
2007/0014563 A1* 1/2007 Ferro ..... F21V 11/06
396/199
2013/0322069 A1* 12/2013 Liao ..... F21S 8/02
362/235

* cited by examiner

MANHOLE LIGHTING SYSTEM

CROSS-REFERENCE TO RELATED APPLICATIONS

This application claims priority under 35 U.S.C. §119 to provisional application Ser. No. 62/000,789 filed May 20, 2014 and 62/034,542 filed Aug. 7, 2014, herein incorporated by reference in their entirety.

FIELD OF THE INVENTION

The present invention generally relates to a manhole lighting system. Preferably, the manhole lighting system includes a battery powered, water and wear resistant lighting apparatus which can be secured in place to allow for individuals and equipment to pass through the manhole and operate below the manhole.

BACKGROUND OF THE INVENTION

Currently, operating in manholes to perform repair or installation work generally requires either hand held or wearable lighting equipment or external lighting which obstructs access to the manhole. Hand held lighting equipment, such as flashlights, typically has a narrow beam of light and requires at least one operator to hold the light, thus minimizing their ability to assist in any necessary or desired repair or installation work. Where two hands are needed, the operator must either place the flashlight on the ground, hold it in another way (for example, in their arms, legs, mouth, etc.), or have an assistant. Placing the flashlight at another location is less than ideal as it generally does not allow for the light to be focused in the desired location. Having an assistant increases costs and minimizes the already limited working space. There is therefore a need to address these issues.

Using external lighting, such as stand lights, allows for a single operator to perform the required installation or repair work. However, stand lights or external lighting generally, may tip over, fall, or move as equipment, cables, and operators enter and exit the manhole. Such external lighting presents an obstacle at the job site and takes time to set up, place, and focus. Additionally, some external stand lights require connection to an external power source. There is therefore a need to address these issues as well.

What is needed is an apparatus for lighting a manhole which addresses these and other issues in the art.

BRIEF SUMMARY OF THE INVENTION

Therefore it is a primary object, feature, and/or advantage of the present invention to improve over the state of the art.

It is a further object, feature, and/or advantage of the present invention to provide a manhole lighting system which is easy to install.

Another object, feature, and/or advantage of the present invention is to provide a manhole lighting system which is unobtrusive.

Another object, feature, and/or advantage of the present invention is to provide a manhole lighting system which may be installed by a single individual.

A further object, feature, and/or advantage of the present invention is to provide a manhole lighting system which is portable.

A still further object, feature, and/or advantage of the present invention is to provide a manhole lighting system which does not require external power.

Another object, feature, and/or advantage of the present invention is to provide a manhole lighting system which allows for easy ingress and egress with regard to the manhole.

Another object, feature, and/or advantage of the present invention is to provide a manhole lighting system which allows for an operator to use both hands while working in lighted conditions.

One or more of these and/or other objects, features, or advantages of the present invention will become clear from the specification and claims that follow. No single embodiment need exhibit each and every object, feature, or advantage.

DETAILED DESCRIPTION OF THE PREFERRED EMBODIMENT

Figure 1A:
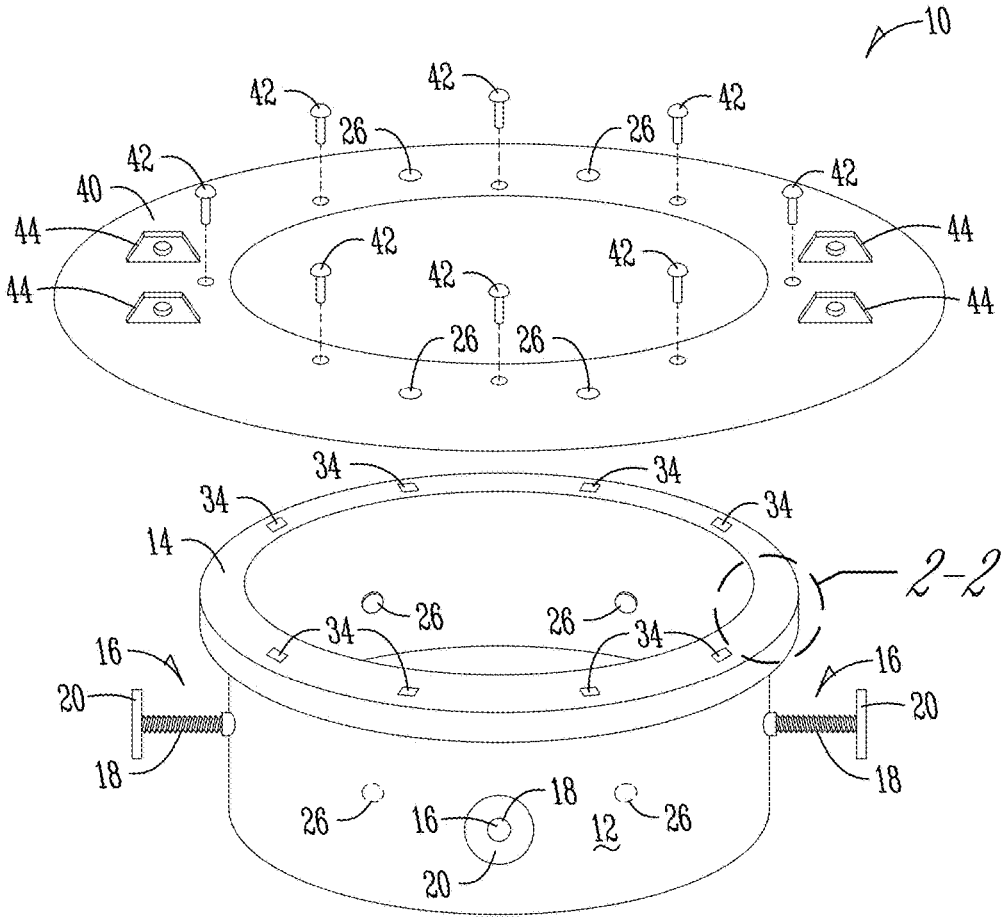
FIG. 1A is a perspective view of the manhole lighting system of the present invention.

FIG. 1A shows a perspective view of the manhole lighting system 10 of the present invention. The manhole lighting system 10 of the present invention preferably includes a generally ring shaped body 12 which is attached to a rim 14. The edges of the body 12 and/or rim 14 may be rounded to allow for easier use in certain situations, such as with a clean out cover. Securing means 16, such as screws, expansion springs, or any other suitable pressure fitting apparatus is secured to the body 12 at desired locations. For example, as shown in FIGS. 1A and 4C, four adjustable screws 18 or threaded rods are placed at approximately ninety degree increments around the ring shaped body 12.

The adjustable screws 18 extend generally perpendicularly through the body 12 and include a contact surface 20. As the screws 18 are tightened, the contact surface 20 is extended radially outwardly from the body 12 until contact is made with the wall of the manhole 22 as shown in FIG. 5A-D. As all four screws 18 are tightened in place, the manhole lighting system 10 of the present invention is secured into position. In this manner, the manhole lighting system 10 of the present invention can be compression fit into place. Other forms of compression fitting or securing the manhole lighting system 10 may also be used. For example and as an alternative, the manhole lighting system 10 of the present invention can be clamped in place through use of a vector clamp style arrangement. This enables the lighting system 10 to be secured around pipes, vacuum tubes, etc. Alternatively still, the manhole lighting system 10 of the present invention can include one or more magnets 34 on the rim 14 (as shown in FIG. 1A) to enable the lighting system 10 of the present invention to be secured to the side, top or bottom of any ferrous surface or any surface capable of exhibiting magnetic properties.

The rim 14 also allows for the manhole lighting system 10 of the present invention to be dropped into place. Preferably, the rim 14 extends radially outwardly enough to prevent the manhole lighting system from falling into the manhole 22. The rim 14 may be a continuous piece of material or may consist of sections of material extending generally perpendicularly and radially outward from the body 12. Having the rim 14 be wider than the manhole 22 allows the operator to simply drop in the manhole lighting system 10 of the present invention for quick jobs which do not require the manhole lighting system 10 to be held securely in place with the securing means 16.

Figure 4A:
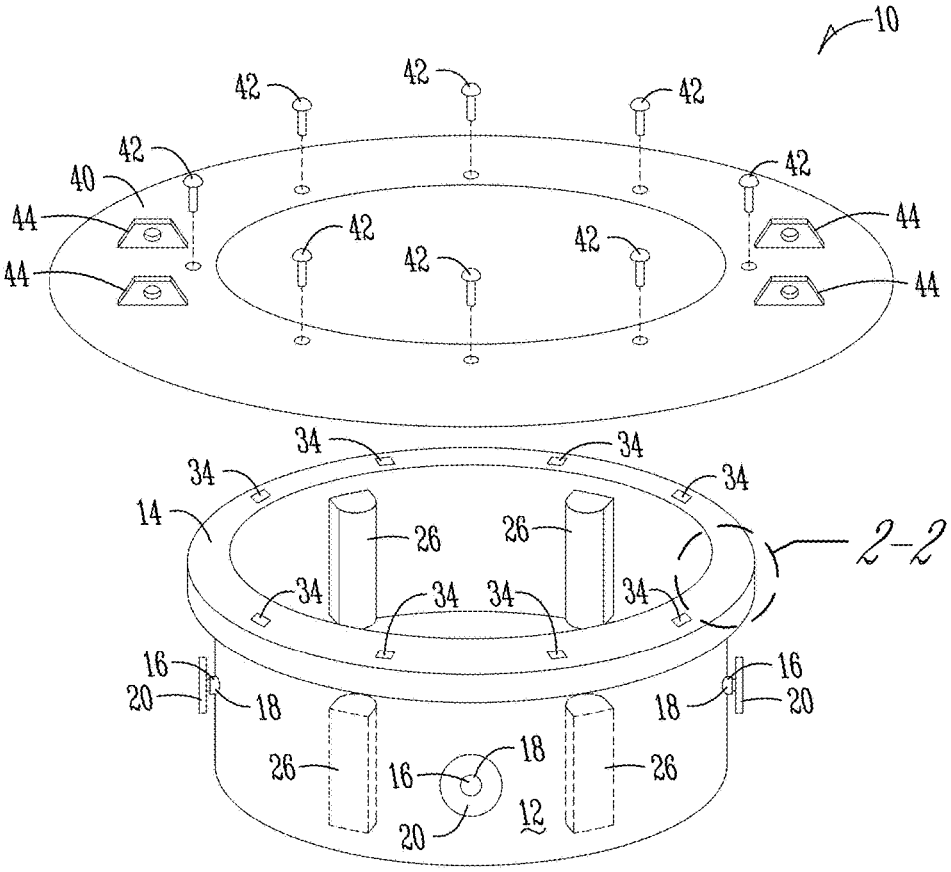
FIG. 4A is a perspective view of the manhole lighting system of the present invention including lights pointed in a generally downward direction.
Figure 4B:
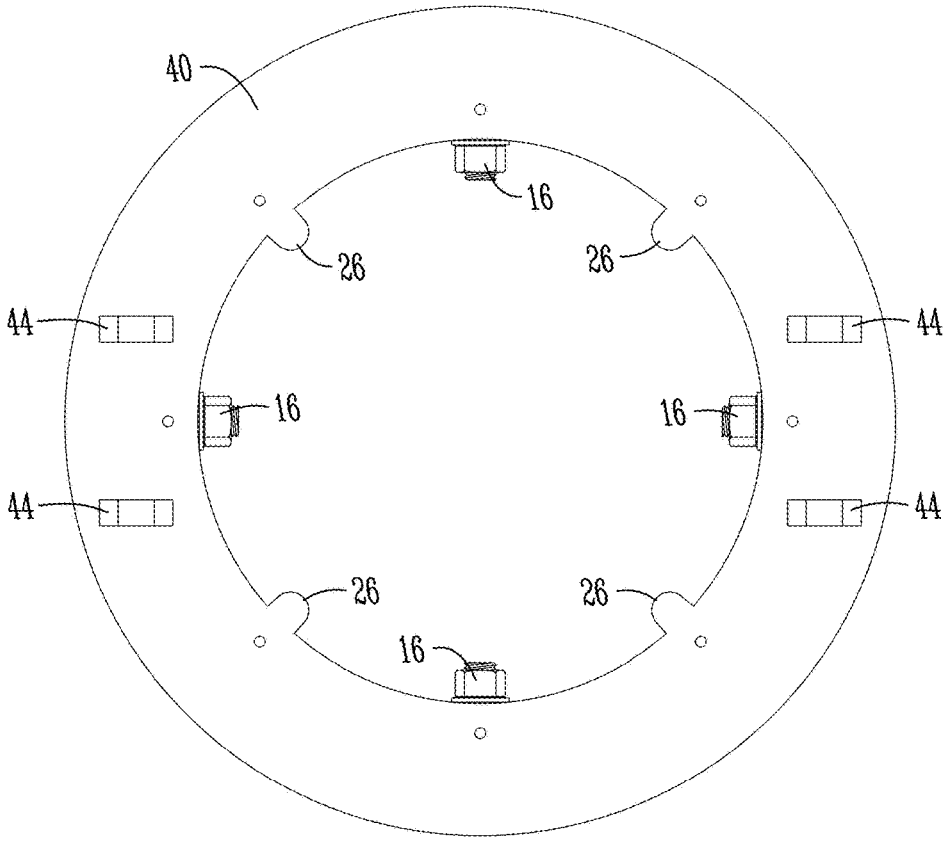
FIG. 4B is a top view of the manhole lighting system of FIG. 4A.
Figure 4C:
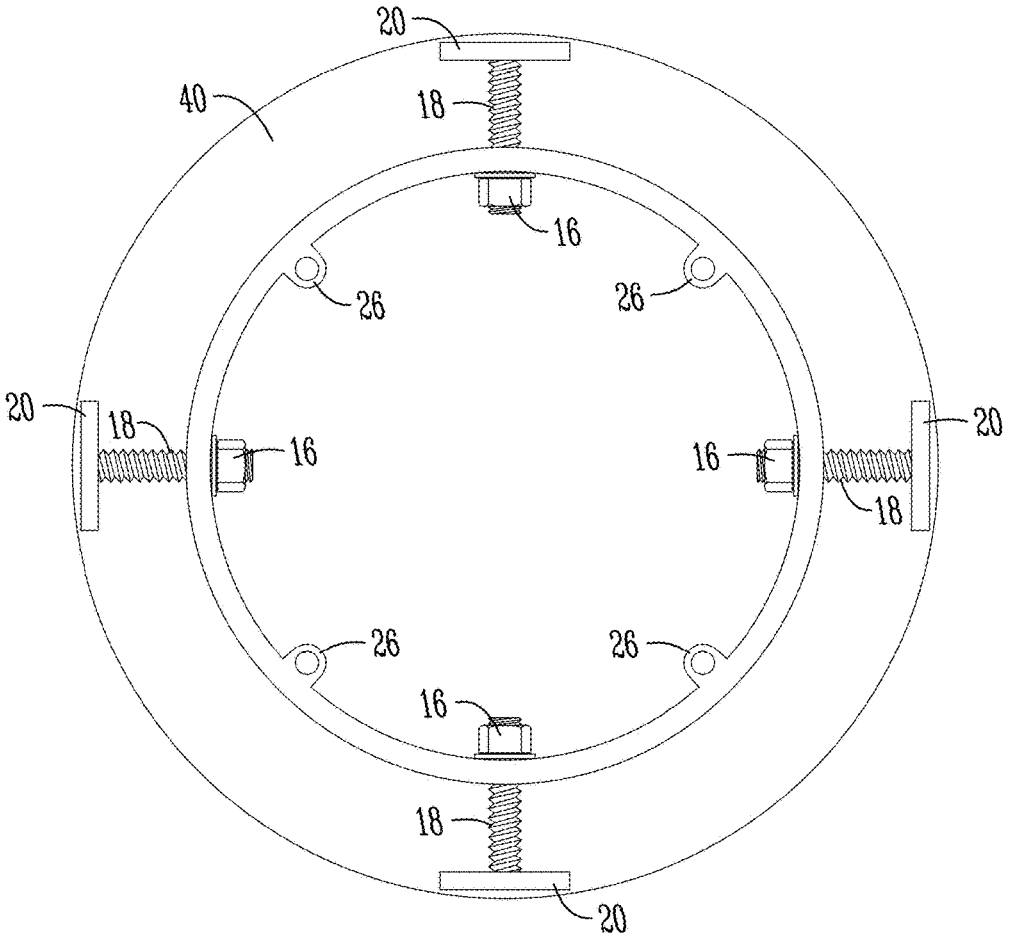
FIG. 4C is a bottom view of the manhole lighting system of FIG. 4A.
Figure 5A:
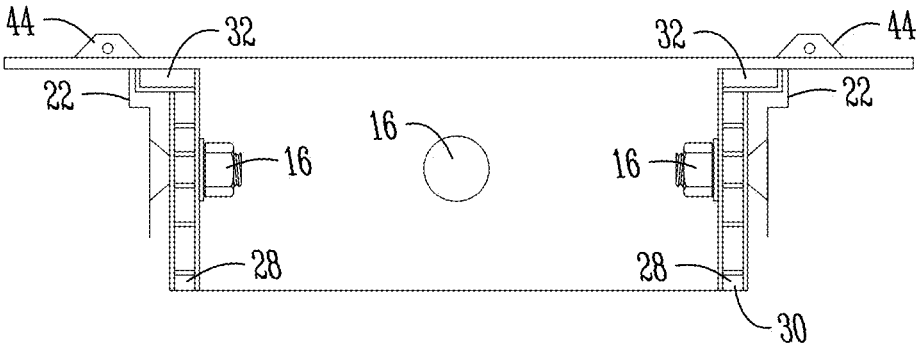
FIG. 5A is a cross-sectional view of the manhole lighting system of the present invention.
Figure 5B:
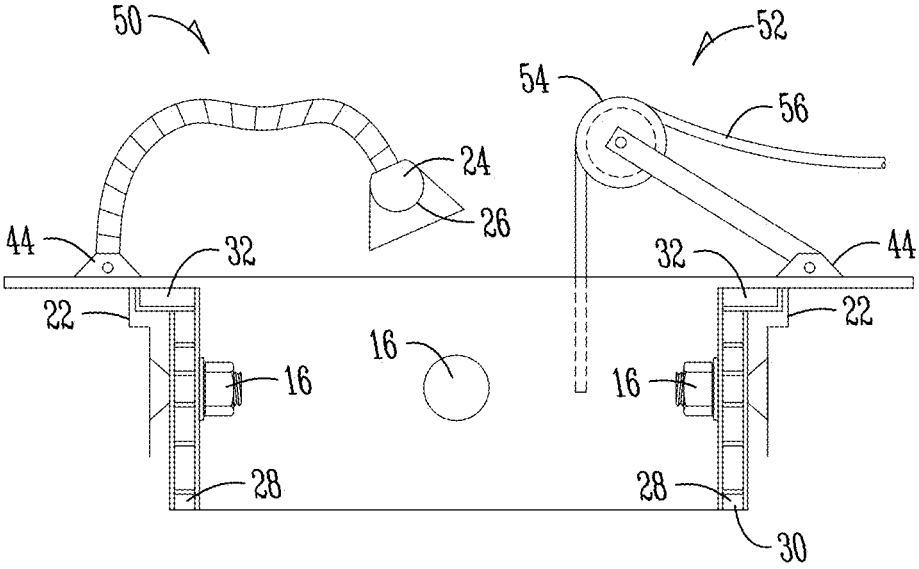
FIG. 5B is a cross-sectional view of an alternative embodiment of the manhole lighting system of the present invention.
Figure 5C:
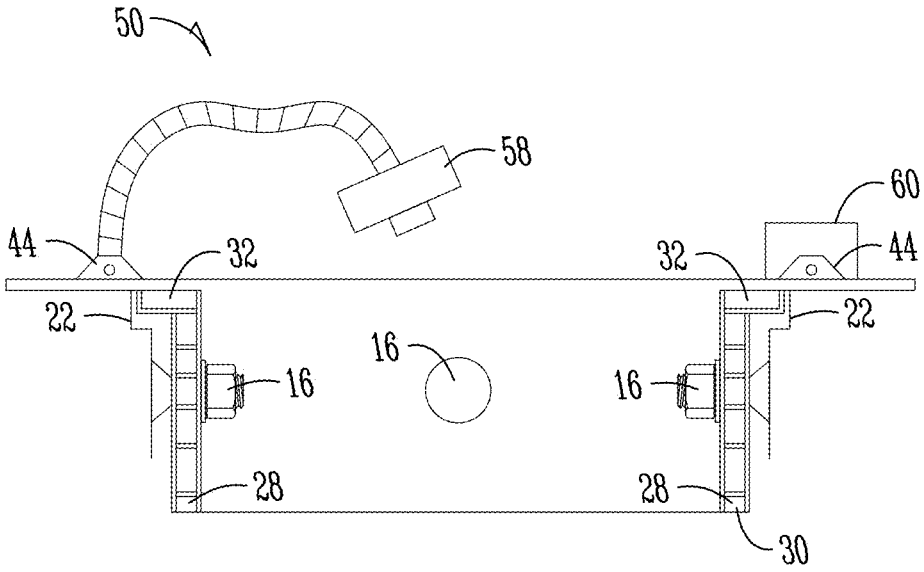
FIG. 5C is a cross-sectional view of an alternative embodiment of the manhole lighting system of the present invention.

The lighting fixture 24 of the manhole lighting system 10 is generally shown in FIG. 4A-C and may be provided by one or more lights 26 secured to the body 12 to shine generally downward. Preferably, the lights 26 are LED lights which are embedded in the body 12 in a cavity 28 behind a protective element 30, such as strong clear Plexiglas. The lights 26 are preferably arranged to shine in multiple directions. Alternatively, the lights 26 can be contained in a rope light or other easily replaceable multi-light system. Securing the lights 26 within a cavity and behind a generally transparent cover helps to protect the lights from wear and minimizes exposure to the often damp and dirty conditions present in a pit or pipe to which the manhole 22 provides access. As an alternative, the lights 26 may be flexibly secured to the light ring body 12 as shown in FIG. 5B, thus enabling a user to shine one or more of the lights in a preferred direction.

The lights 26 are preferably powered by a battery source 32, such as a lithium ion battery. The battery source 32 is preferably stored in an easily accessible location, such as within a section of the rim 14 or body 12. For example, the batter source 32 can be located behind a panel (not shown) in the rim 14 to allow the battery source 32 to be replaced easily while the manhole lighting system is installed or in use.

The battery source 32 is operatively connected to the lights 26 and preferably a control circuit (not shown). The control circuit allows the lights to be turned on or off, either manually by linking to an external switch (not shown) or to a photo detector which can turn the lights 26 on when needed. Preferably, both an external switch and a photo detector are used to prevent the lights 26 from coming on unless both needed and desired. The control circuit may be part of or operatively linked to a motherboard or other computer processor which operates, controls, or communicates with a Bluetooth transceiver, Wi-Fi transceiver, camera, depth sensor, temperature sensor, noxious fume detector or other accessory 58, 60. Alternatively still, the body 12 of the lighting system 10 can include one or more smartphone holding brackets for a user to secure a smartphone.

Figure 1B:
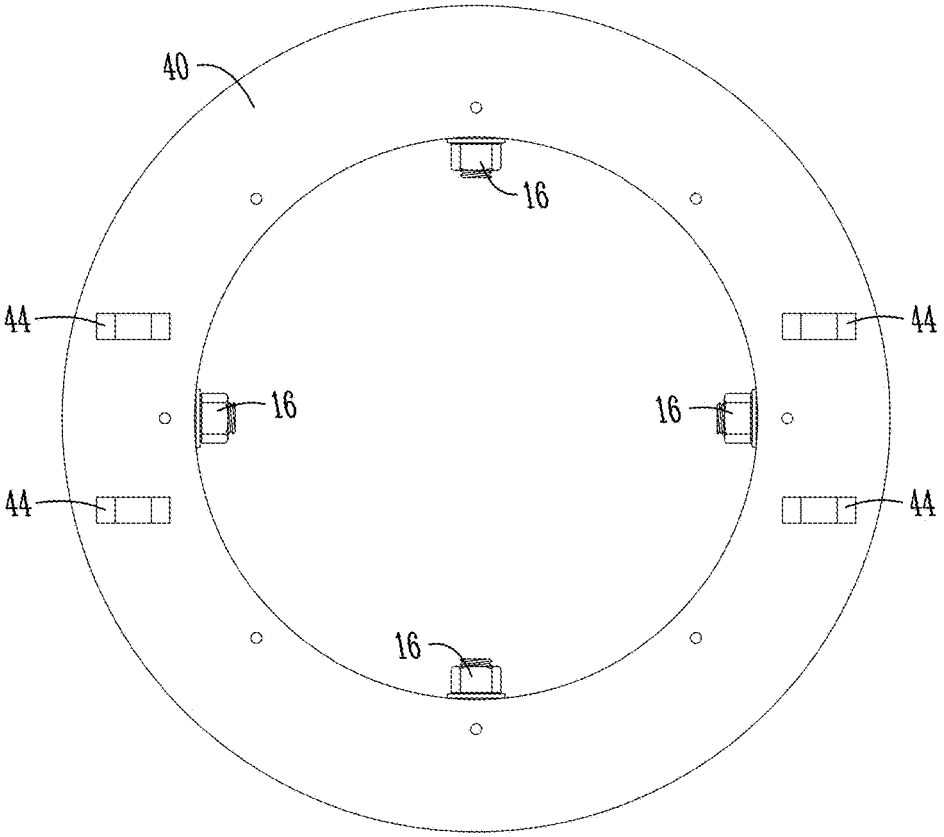
FIG. 1B is a top view of the manhole lighting system of the present invention.
Figure 2:
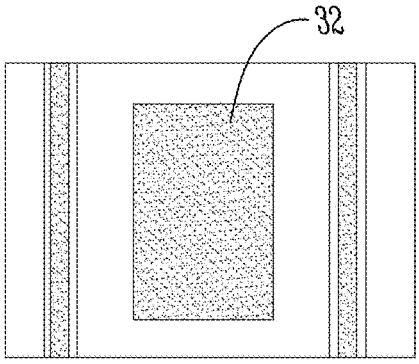
FIG. 2 is a cross-sectional view of a section of the manhole lighting system of the present invention.
Figure 3:
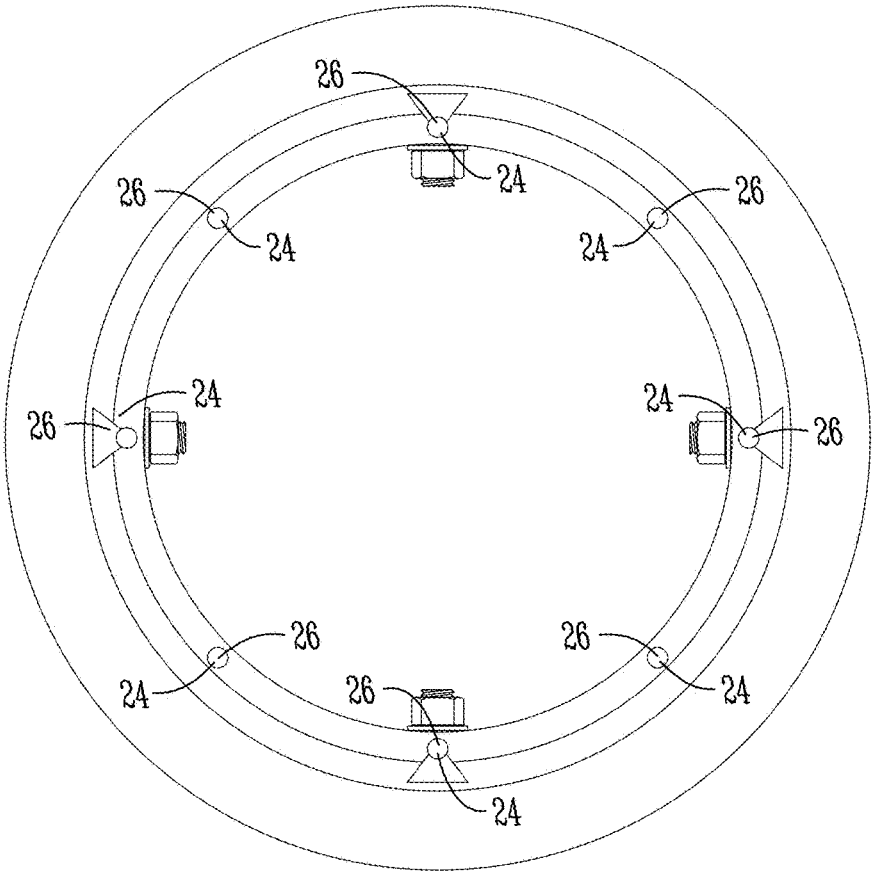
FIG. 3 is a bottom view of the manhole lighting system of the present invention.

As shown in FIGS. 1, 4 and 5, the manhole lighting system 10 of the present invention can also include an accessory ring 40 with a plurality of accessory mounting brackets 44 for larger accessories. The accessory ring 40 preferably is secured to the rim 14 of the lighting system 10 using a plurality of screws 42. Alternatively, the accessory ring 40 can be secured in any desired way, and may be mounted permanently or incorporated as part of the rim 14. The accessory ring 40 can include one or more accessory brackets 44. It should be understood based on the descriptions above that the accessory bracket(s) 44 may utilized to attach one or more the features described herein. For example, a downrigger system 52, lockable safety covers, flex lights, 20 foot extension lights, see through removable safety covers, pop up safety cones, depth sensors 58, gps transceivers 60, video cameras 58, or other equipment may be secured to the accessory bracket(s) 44. Example embodiments are shown in FIGS. 5B and 5C.

Preferably, the body 12, the rim 14, and the accessory ring 40 are made from machined aluminum. Alternatively, the body 12, the rim 14, and the accessory ring 40 may be made assembled from stamped metals, such as stainless steel, tin, or any other metal. Alternatively still, the body 12, the rim 14, and the accessory ring 40 may be molded from a durable plastic or formed from any other materials with sufficient strength and durability to operate in manhole conditions.

The manhole lighting system as discussed above allows an operator to work in the area under the manhole without the need for additional flashlights, wearable lighting or external lighting above the manhole. This allows for single operators to use both hands while performing repair, installation, or inspection work. The manhole lighting assembly 10 of the present invention can also be used in grain bin lighting, railcar lighting, lighting for confined spaces, and can be made in any shape, such as square, triangle, or oval. If the rim 14 and accessory ring 40 are not included, the manhole lighting system 10 can be mounted in any shaft or longer structure and pressure fit to the structure's interior walls. For example, an expanding outer wall can be used as the securing means 16. The lighting system 10 can also be wired into a 110V outlet for use or charging. The manhole lighting system 10 can have lights in both top and bottom surfaces to provide lighting for deeper manholes.

Figure 5D:
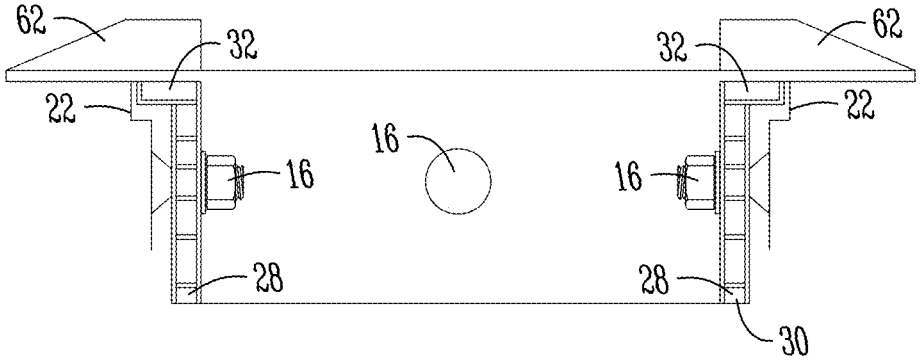
FIG. 5D is a cross-sectional view of an alternative embodiment of the manhole lighting system of the present invention.

Additionally, warning rings and safety rings 62 can be added on top of the rim 14, as shown in FIG. 5D. For example, a hexagonally shaped safety ring can be removably secured to the rim 14. The safety ring 62 is preferably a bright color and includes at least one raised or elevated surface to alert a passerby both visually and physically to the presence of the open hole typically found when the lighting system 10 is in use.

The invention has been shown and described above with the preferred embodiments, and it is understood that many modifications, substitutions, and additions may be made which are within the intended spirit and scope of the invention. The present invention is not to be limited to any specific embodiment described herein.

What is claimed is:

1. A lighting system, the lighting system comprising;

a ring shaped body having a ring top, a ring bottom, a ring inside wall and a ring outside wall;

a rim extending generally perpendicularly away from the ring outside wall;

a light secured to the body wherein the light projects in a direction consistent with a direction going from the ring top to the ring bottom;

an accessory ring removably secured to the rim, wherein the accessory ring comprises a plurality of mounting brackets for operatively attaching one or more tools or peripheral devices; and a power source operatively connected to the light.

2. The lighting system of claim 1 wherein the light is angled away from the rim.

3. The lighting system of claim 1 wherein the light is secured to the ring shaped body proximate to the rim.

4. The lighting system of claim 1 wherein the power source is a battery.

5. The lighting system of claim 1 wherein the light is flexibly secured to the accessory ring.

6. A portable lighting system for use with a manhole, the lighting system comprising:

a ring shaped body having a top surface, a bottom surface, an outside wall and an inside wall, the ring shaped body defining a body perimeter;

wherein the body perimeter is configured to fit within an opening of the manhole;

a retention member operatively secured to the body, said retention member configured to extend outwardly from the body and secure the lighting system within the opening of the manhole; and a plurality of lights secured about the body perimeter.

7. The portable lighting system of claim 6 wherein the retention member is a rim secured proximate to the top surface of the body, said rim configured to extend perpendicularly outwardly from the body outside wall.

8. The portable lighting system of claim 7 further comprising an accessory ring secured to the rim.

9. The portable lighting system of claim 8 wherein the accessory ring comprises one or more accessory mounting brackets.

10. The portable lighting system of claim 7 further comprising a further comprising a safety ring removably attached to the rim, said safety ring having at least one raised or elevated surface.

11. The portable lighting system of claim 6 wherein the retention member is operatively attached to the body perimeter, said retention member comprising an adjustable screw or a threaded rod extending radially outward from the body and is configured to increase or reduce pressure exerted on an interior surface of the manhole to secure the lighting system in place.

12. The portable lighting system of claim 6 wherein the retention member is a screw extending outwardly from the ring shaped body.

13. A portable lighting system, the lighting system comprising:

a ring shaped body having a top surface, a bottom surface, an outside wall and an inside wall, the ring shaped body defining a body perimeter;

a rim secured to the body and extending away from the outside wall;

a magnet secured to the rim;

a plurality of lights secured about the body perimeter;

a power source operatively connected to the plurality of lights;

a controller operatively connected to the plurality of lights and the power source;

a camera removably secured to the body and operatively connected to the power source;

a sensor operatively connected to the power source and secured to the body; and a transceiver operatively connected to the power source and secured to the body.

14. The portable lighting system of claim 13 further comprising an accessory ring removably attached to the rim of the ring shaped body.

15. The portable lighting system of claim 14 wherein the accessory ring comprises a plurality of mounting brackets.

16. The portable lighting system of claim 15 wherein the camera is flexibly connected to the accessory ring via a one of the plurality of mounting brackets.

17. The portable lighting system of claim 13 further comprising a safety ring removably attached to the top of the rim.

18. The portable lighting system of claim 17 wherein the safety ring includes a raised or elevated edge that is configured to alert a pedestrian passing by the lighting system.

19. The portable lighting system of claim 13 wherein at east one of the plurality of lights is flexibly secured to the body.

20. The portable lighting system of claim 13 further comprising a retention member operatively attached to the body and extending outwardly from the body perimeter, said retention member configured to secure the lighting systems within an opening of a manhole.

* * * * *